US011205553B2

(12) United States Patent
Glomon et al.

(10) Patent No.: US 11,205,553 B2
(45) Date of Patent: Dec. 21, 2021

(54) ELECTRICAL SWITCHING DEVICE WITH SEPARABLE CONTACTS AND CIRCUIT BREAKER COMPRISING SUCH A DEVICE

(71) Applicant: Schneider Electric Industries SAS, Rueil Malmaison (FR)

(72) Inventors: Loïc Glomon, Jarrie (FR); Javier Herreros, Grenoble (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 17/108,119

(22) Filed: Dec. 1, 2020

(65) Prior Publication Data

US 2021/0166906 A1 Jun. 3, 2021

(30) Foreign Application Priority Data

Dec. 3, 2019 (FR) ..... 1913658

(51) Int. Cl.
*H01H 71/12* (2006.01)

(52) U.S. Cl.
CPC ..... *H01H 71/128* (2013.01); *H01H 2221/016* (2013.01)

(58) Field of Classification Search
CPC ..... H01H 71/128; H01H 2221/016
(Continued)

(56) References Cited

U.S. PATENT DOCUMENTS 4,935,712 A * 6/1990 Oyama ..... H01H 71/525 335/164
6,373,009 B1 * 4/2002 Prohaska ..... H01H 3/001 200/401

FOREIGN PATENT DOCUMENTS

EP 3291274 A1 3/2018
FR 2687249 A1 8/1993
WO 2008034530 A1 3/2008

OTHER PUBLICATIONS

Republique Francaise Institut National De La Propriete Industrielle, French Search Report and Opinion for French Patent Application No. FR1913658 dated Jun. 29, 2020, 9 pages.

* cited by examiner

*Primary Examiner* — Edwin A. Leon
*Assistant Examiner* — Iman Malakooti
(74) *Attorney, Agent, or Firm* — Locke Lord LLP

(57) ABSTRACT

Electrical switching device, including separable electrical contacts, a switching mechanism and a control lever. This switching mechanism is designed to move the separable contacts reversibly and selectively between a stable closed state and a stable open state. The control lever can be moved between a closing position and an opening position. The switching mechanism is configured to move the separable contacts from their closed state to their open state when the lever is moved from its closing position to its opening position, and to this end includes a spring which, between the closing position of the lever and a first intermediate position referred to as the "dead point", exerts a force that opposes the movement of the lever and which, between the dead-point position and the opening position of the lever, exerts a force that drives the contacts towards the open position. The switching mechanism comprises a holding device which is configured to prevent the switching mechanism from moving the contacts towards their open position when the lever is moved from the closing position to the opening position and when the lever has not passed a second intermediate position located between the dead-point position and the opening position.

10 Claims, 5 Drawing Sheets

(58) Field of Classification Search
USPC ..... 200/468
See application file for complete search history.

ELECTRICAL SWITCHING DEVICE WITH SEPARABLE CONTACTS AND CIRCUIT BREAKER COMPRISING SUCH A DEVICE

TECHNICAL FIELD

The present invention concerns an electrical switching device.

The invention relates in particular to the field of electrical switching devices with separable contacts such as moulded casing circuit breakers and switches.

BACKGROUND

Such separable contact switching devices include a switching mechanism the function of which is to move the electrical contacts of the device between an open state and a closed state, for example in response to action of a tripping device or an operative.

A number of types of switching mechanisms are known, in particular tumbler type switching mechanisms.

FR 2 687 249-A1 describes for example a circuit breaker including such a tumbler switching mechanism. That switching mechanism includes an articulated toggle joint that is connected to a mobile contact on the one hand and is driven by a lower link on the other hand. The lower link is articulated to an upper link, itself mounted to pivot on a hook, the hook cooperating with a latch for maintaining the hook in a locked position. The switching mechanism further includes a control lever that pivots about a fixed axis and that is connected to one end of a spring, another end of the spring being connected to the shaft of the toggle joint by means of the upper link. When the switching mechanism is in the closed state the spring conjointly tends to hold the handle in a closing position, to hold the upper link in a first position and to move the hook out of its position in the locked state.

These known mechanisms can however cause problems on manual opening, that is to say when the switching mechanism is in the closed state and an operative causes the lever to pivot towards an opening position in order to cause the switching mechanism to go to the open state.

It has in particular been observed that when an operative manipulates the control lever to open the electrical contacts the speed at which the contacts open may be dependent on the speed at which the lever moves. If the lever moves slowly or the switching mechanism is warm, it can happen, in particular when the mechanism passes the dead point position, that the latter fails to open the contacts at a sufficient speed, which prevents them from opening correctly. This can lead to the appearance of electrical arcs between the electrical contacts and risks damaging the electrical contacts or even welding them to one another, which prevents the switching device from interrupting the current correctly.

SUMMARY

It is these problems that the invention is more particularly intended to remedy by proposing a switching device in which the speed at which the contacts open is independent of the speed at which the control lever is actuated.

To this end the invention concerns an electrical switching device including separable electrical contacts, a switching mechanism and a control lever, in which:

- the switching mechanism is designed to move the separable contacts reversibly and selectively between a stable closed state and a stable open state,

- the control lever can be moved between a closing position and an opening position,
- the switching mechanism is configured to move the separable contacts from their closed state to their open state when the lever is moved from its closing position to its opening position, and to this end includes a spring which, between the closing position of the lever and a first intermediate position referred to as the "dead point" position, exerts a force that opposes the movement of the lever and which, between the dead-point position and the opening position of the lever, exerts a force that drives the contacts towards the open state.

In accordance with the invention, the switching mechanism includes a holding device which is configured to prevent the switching mechanism from moving the contacts towards their open state when the lever is moved from the closing position to the opening position and when the lever has not passed a second intermediate position located between the dead-point position and the opening position.

Thanks to the invention the speed at which the contacts open is independent of the speed of the lever. The contacts begin to open while the lever is in an intermediate position offset relative to the dead point position at which the spring generates a movement in rotation of the components of the switching mechanism sufficient to separate the contacts at a sufficient speed. The appearance of electrical arcs is limited and the durability of the electrical contacts and of the switching mechanism is thereby lengthened.

In accordance with advantageous but non-obligatory aspects of the invention, an electrical switching device of this kind may incorporate one or more of the following features in any technically permissible combination:

- the switching mechanism includes a safety device that prevents the movements of the lever from the second intermediate position towards the opening position if the separable contacts are not completely open and the holding device is integrated into the safety device.
- one of the separable contacts is a mobile contact connected to the switching mechanism, the safety device including a plate that is connected to the mobile contact and that cooperates with a latch for automatically tripping the switching mechanism and the holding device includes two projections respectively connected to the plate and to the latch, the two projections cooperating together in such a manner that the plate prevents the movements of the mobile contact, the lever being furthermore connected to a pusher pin that is adapted, when the lever is in the second intermediate position, to push the plate into a position in which the two projections no longer cooperate together.
- the two projections are a stop and a lug, the stop being connected to the plate whereas the lug is connected to the latch.
- when the control lever is between the closing position and the second intermediate position, the safety device, subjected to its weight, is in a position such that the stops remain facing the lugs of the latch.
- the safety device is made of metal.
- the safety device includes a first element including the plate and a second element connected to the first element and including the stop.
- the latch pivots about a pivot axis and the second element is connected to a second end of the plate, the first element and the second element defining between them an internal volume in which the pivot axis of the latch is accommodated in such a manner as to limit the amplitude of the movements of the safety device when the stops are not cooperating with the lugs.

the dead point position and the second intermediate position of the lever define between them an angle between 1° and 6° inclusive, preferably between 2° and 5° inclusive, more preferably between 3° and 4° inclusive.

the switching device is a circuit breaker.

BRIEF DESCRIPTION OF THE DRAWINGS

The invention will be better understood and other advantages thereof will become more clearly apparent in the light of the following description of one embodiment of a switching device and of a circuit breaker including such a device conforming to its principle, given by way of example and with reference to the appended drawings, in which.

DETAILED DESCRIPTION

Figure 1:
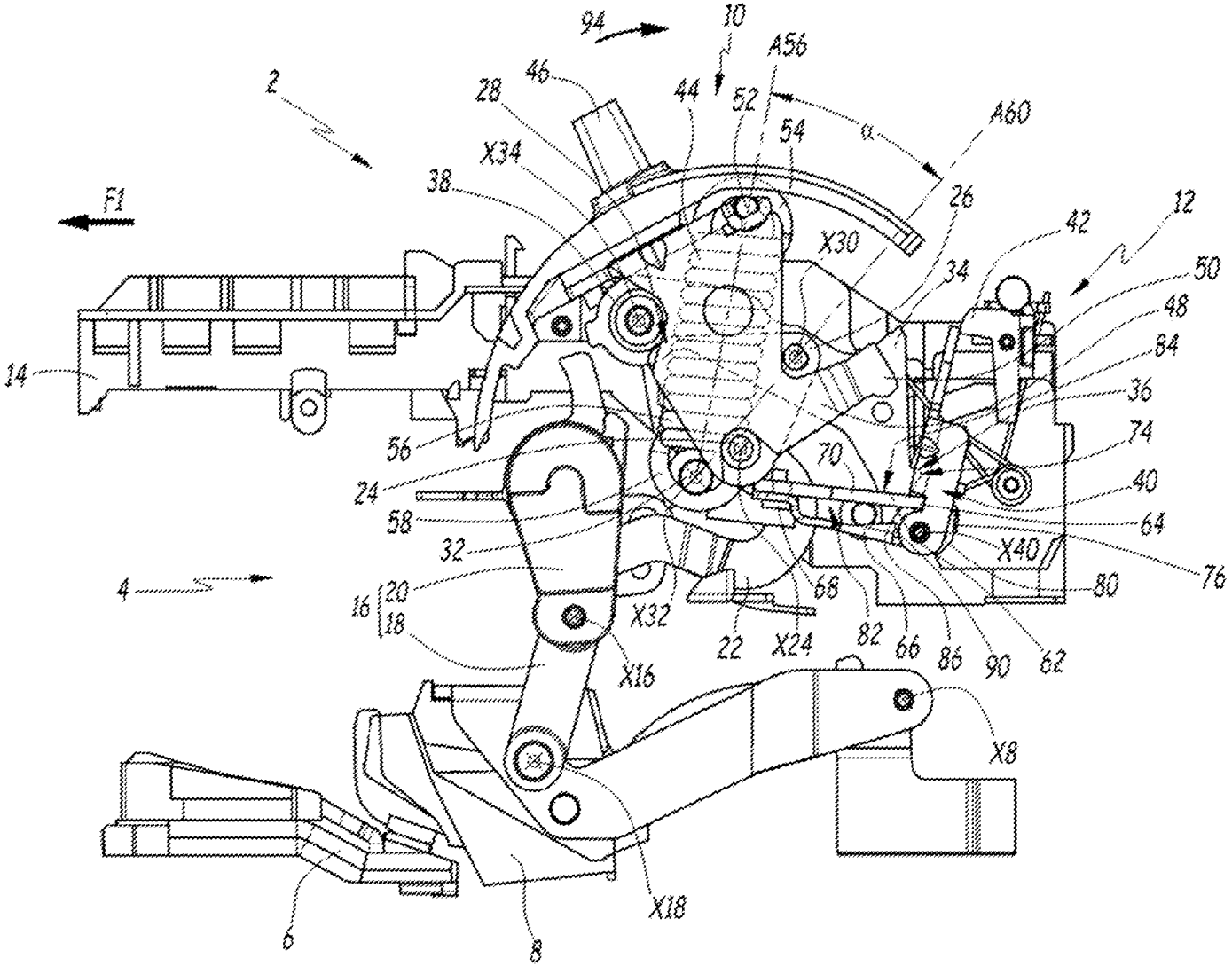
FIG. 1 is a diagrammatic representation in side view of an electrical switching device in accordance with the invention including a holding device, some components of the switching device being hidden to facilitate reading.

FIG. 1 represents an electrical switching device 2 with separable contacts, such as a circuit breaker, in particular a moulded casing circuit breaker.

This example is not limiting on the invention and the device 2 may instead be some other type of electrical switching device such as a switch or a contactor.

In the example, the switching device 2 includes a switching mechanism 4 configured selectively to bring into contact or to separate a fixed electrical contact 6 and a mobile electrical contact 8.

The fixed contact 6 and the mobile contact 8 are therefore separable contacts that are connected to respective connecting terminals of the device 2 and are for example associated with one pole.

Some examples of the device 2 are multipolar devices and then include a pair of separable contacts 6 and 8 for each pole. The mechanism 4 is then common to the poles. What is described is true for one pole and can be transposed to the other poles, the latter not being described in order not to burden the application.

The switching device 2 is designed to be actuated manually by means of a control lever 10. The switching device 2 can also include a tripping device 12, for example an electronic tripping device or an electromechanical tripping device.

In FIG. 1 the switching mechanism 4 is represented in a so-called "closing" configuration in which the mobile contact 8 is in contact with the fixed contact 6, thus allowing the circulation of an electrical current. The contacts 6 and 8 are in a state termed the "closed state".

When the mobile contact is separated from the fixed contact 6 and is electrically connected to the fixed contact 6, the contacts 6 and 8 are in a so-called "open" state and the switching mechanism 4 is in a so-called "opening" configuration.

Some examples of the switching device 2 include a frame 14, partly shown, on which are mounted at least some of the components of the switching device 2.

The frame 14 may be placed inside a casing, not shown, that is made from an electrically insulating material.

Some examples of the fixed contact 6 are fixed relative to the frame 14 with the mobile contact 8 mounted to pivot relative to the frame 14 about a main axis X8.

In the remainder of the description, and unless otherwise mentioned, the rotation movements of the components occur about respective axes parallel to the main axis X8 and the translation movements of the components occur in planes orthogonal to the main axis X8. In the example illustrated in FIGS. 1, 2, 3 and 5 the axis X8 is perpendicular to the geometrical plane of the figures.

The movements of the mobile contact 8 are linked to the switching mechanism 4, which here includes a "toggle joint" type connection 16. This connection is simply referred to as the "toggle joint 16" in the remainder of the description.

The toggle joint 16 includes a bottom link 18 and a top link 20 that are articulated to one another at one of their respective ends about an axis X16 of the toggle joint 16.

The axis X16 is parallel to the main axis X8.

At the end opposite the axis X16 the link 18 is pivotally mounted on the mobile contact 8 to pivot about an axis X18 that is parallel to the main axis X8.

In an analogous manner, the link 20 is mounted to pivot relative to the frame 14 about an axis, not shown, parallel to the main axis X8 and situated at the end opposite the end including the axis X16. The top link 20 is connected to a shaft, termed the "pole shaft", that serves to synchronize the opening of a plurality of switching devices of the same type as the switching device 2 mounted in parallel. The pole shaft is not drawn in the figures.

When the mechanism 4 is in the closing configuration, the toggle joint 16 is in a so-called "deployed" configuration in which the links 18 and 20 form between them an angle of maximum amplitude, close to 180° but strictly less than 180°, and the separable contacts 6 and 8 are in the closed state. In the opening configuration represented in FIG. 5 the toggle joint 16 is completely folded up, that is to say the links 18 and 20 form between them an angle of minimum but non-zero amplitude, and the separable contacts 6 and 8 are said to be "completely open".

The toggle joint 16 is actuated by a bottom link 22 which here is hook-shaped. The link 22 has a first end mounted to pivot relative to the top link 20 about an axis next to the axis X16 and parallel to the axis X16 and a second end that receives a rod 24. Here the rod 24 is cylindrical and centred on an axis X24 parallel to the main axis X8.

The mechanism 4 also includes an upper link 26 connected to the rod 24.

In the drawings, although the bottom link 22 is situated at the same height as the top link 20, the link 22 is referred to as the bottom link 22 because it is situated below the upper link 26. The modifiers "top", "bottom", "lower", "upper" are chosen with reference to the orientation of the switching device 2 in the drawings and do not prejudge any particular functioning of the device 2.

In particular, the switching device 2 is preferably intended to be mounted in such a manner that the top is oriented toward the left of the drawings, as represented by an arrow F1 in FIGS. 1 to 3 and 5. The direction of terrestrial gravity is oriented oppositely to the arrow F1, that is to say horizontally toward the right of the drawing.

In this example the upper link 26, partly visible in the figures, has a central body of triangular shape, one apex of which features a bearing surface 28. A second apex of the triangle receives the rod 24 connected to the lower link 22. A third apex of the triangle features a pivot axis X30. The upper link 26 features in the vicinity of the second apex, an extension that receives a rod 32, the rod 32 being centred on an axis X32 parallel to the main axis X8.

Alternative embodiments of the switching mechanism 4 could omit the toggle joint 16 driven by the links 22 and 26. Other structures of switching mechanisms 4 are possible, those structures fulfilling the same functions as the mechanism 4 illustrated.

In the example illustrated, the pivot axis X30 parallel to the main axis X8 is formed in an intermediate part of a hook 34.

Here the hook 34 has an elongate shape with a first end mounted to pivot relative to the frame 14 about an axis X34 parallel to the axis X8 and a second end including a lug 36.

A rod 38 of cylindrical shape is disposed coaxially with the axis X34. In the closing configuration illustrated in FIG. 1 the bearing surface 28 of the upper link 26 is in contact with the rod 38.

The lug 36 cooperates with a latch 40. The latch 40 is mounted to pivot relative to the frame 14 about an axis X40 parallel to the axis X8. In the closing configuration illustrated in FIG. 1 one end of the latch 40 cooperates with a pawl 42, the pawl 42 preventing rotation movements of the latch 40 in the clockwise direction about the axis X40. The pawl 42 is sometimes called a "half-moon latch".

In practice the pawl 42 cooperates with a tripping device and enables automatic actuation of the mechanism by the tripping device without manual intervention of an operative.

It is therefore clear that the pawl 42 is independent of the invention and that it could be omitted.

Some examples of the control lever 10 include a support 44 and a handle 46. The handle 46 is fastened to the support 44, which is mounted to pivot about a pivot axis X47 fixed relative to the frame 14 and parallel to the main axis X8. In the closing configuration represented in FIGS. 1 to 3 the axis X47 coincides with the axis X24 whereas in the opening configuration the axis X47 is separate from the axis X24. For example, the support 44 has a stirrup shape that is symmetrical with respect to a plane orthogonal to the main axis X8. The support 44 includes arms 48 disposed radially relative to the pivot axis X47. Each arm 48 features a boss 50 at a distal end of the axis X47.

In the closing configuration illustrated in FIG. 1 the lever 10 is in a first, so-called "closing" extreme stable position. In the opening configuration illustrated in FIG. 5, in which the separable contacts 6 and 8 are completely open, the lever 10 is in another, so-called "opening" extreme stable position.

Here the support 44 cooperates with a fixing rod 52 that is attached to a first end 54 of a spring 56 whereas a second end 58 of the spring 56 cooperates with the rod 32.

In the example illustrated, the spring 56 is a coil spring that extends in a direction represented by an axis A56. The axis A56 is therefore situated in a plane orthogonal to the axis X32.

The spring 56 is designed to be under tension whatever the relative position of the handle 46 relative to the upper link 26.

A neutral axis A60 of the upper link 26 is also defined as being an axis connecting the axis X32 of the rod 32 and the pivot axis X30 of the link 26. The neutral axis A60 is situated orthogonal to the axis X32.

The neutral axis A60 and the axis A56 of the spring 56 both intersect the axis X32 and define between them a pivot angle $\alpha$. In the closing configuration illustrated in FIG. 1 the lever 10 is in a closing position and the pivot angle $\alpha$ is negative.

Figure 5:
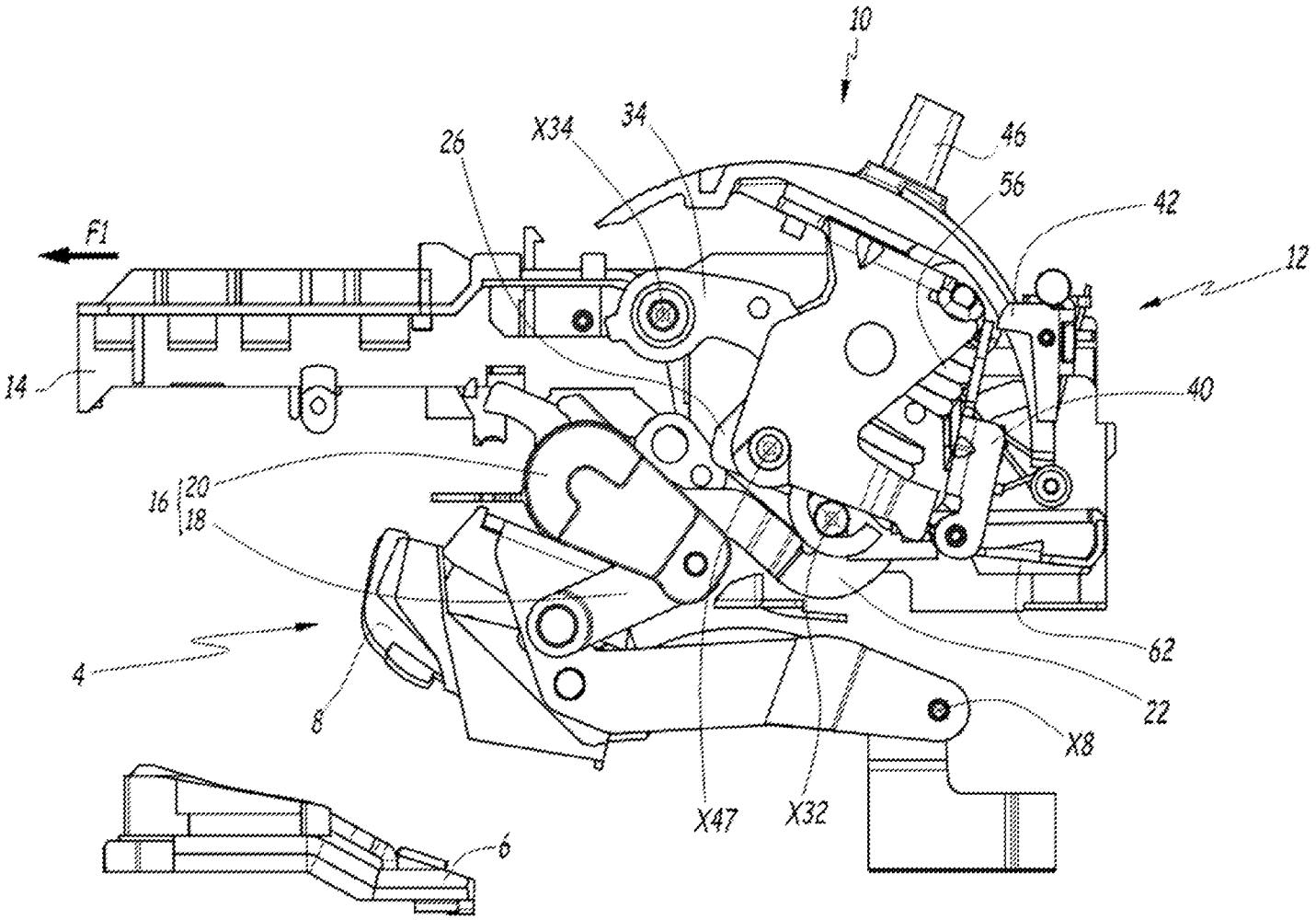
FIG. 5 is a view analogous to FIGS. 1 to 3, the switching device being represented in a fourth configuration different from those of FIGS. 1 to 3.

In the opening configuration represented in FIG. 5 the lever 10 is in an opening position and the pivot angle $\alpha$ is positive.

A so-called "dead point" position of the lever 10 is defined as being an intermediate position between the opening and closing positions of the lever 10. In the example illustrated the dead point position corresponds to a position in which the neutral axis A60 and the axis A56 of the spring 56 are aligned. The angle $\alpha$ is then zero.

The mechanism 4 further includes a safety device 62 that prevents the lever 10 from being placed in the opening position if the separable contacts 6 and 8 are not completely open.

The safety device 62 includes a first element 64 assembled to a second element 66 by means of connecting members 68 which are rivets in the example shown.

The first element 64 includes in a central part a plate 70 that is formed for example by cutting and then bending. The plate 70 is extended at a first end by a hook 72.

Here the hook 72 is situated in a plane both orthogonal to the plate 70 and orthogonal to the main axis X8. The hook 72 cooperates with the rod 32 in such a manner as to connect the first element 64 in translation relative to the rod 32. In other words the safety device 62 is articulated to rotate relative to the lower link 22 about the axis X32 of the rod 32.

Figure 4:
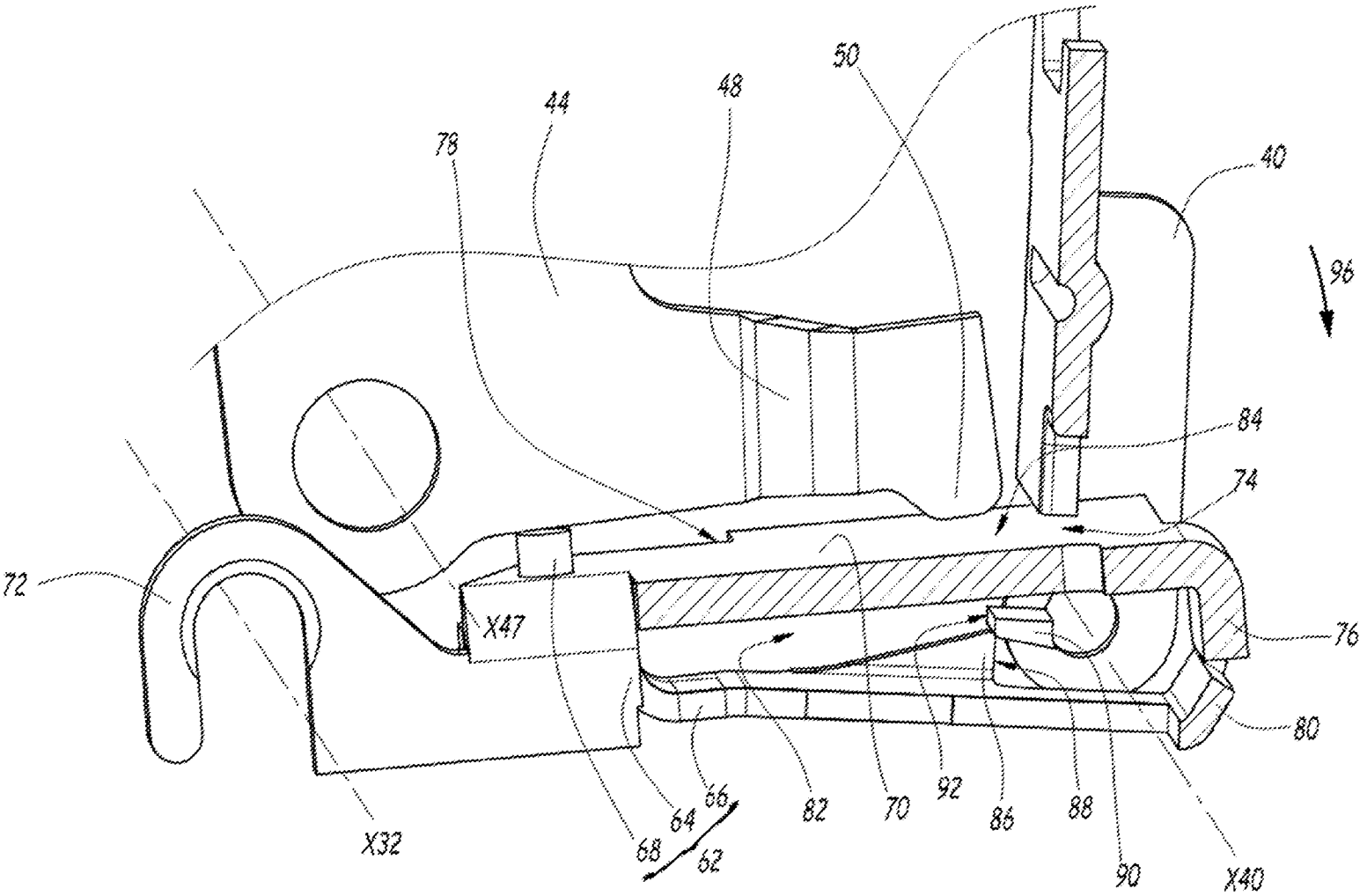
FIG. 4 is a view of the detail IV in FIG. 3, some components being hidden to facilitate reading.

The central part 70 passes through a stop 74 in the latch 40 and has at a second end opposite the hook 72 a curved part 76 oriented towards the second element 66. Notches 78 visible in FIG. 4 are formed in the central part 70 on the side opposite the curved part 76.

Here the second element 66 has a flat shape, produced for example by cutting out and then bending from sheet metal. The second element 66 is connected by a second end to the first element 64 in the vicinity of the hook 72 and includes at a second end opposite the first end a rim 80 oriented towards the first element 64 and situated facing the closed part 76.

The first element 64 and the second element 66 define between them an internal volume 82 in which the pivot axis X40 of the latch 40 is accommodated.

The axis X40 is accommodated with play in the internal volume 82, limiting the amplitude of rotation movements of the safety device 62 about the axis X32.

A face 84 is defined as being a face of the central part 70 oriented away from the internal volume 82.

The second element 66 further includes lateral stops 86 formed on edges of the second element 66 between the first and second ends. The stops 86 are clearly visible in FIG. 4. In the example illustrated each stop 86 has an elongate right-angle triangle shape with a longer side connected to the second element 66, a shorter side 88 and a hypotenuse, the shorter side 88 and the hypotenuse being free, the shorter side being oriented toward the rim 80.

Figure 2:
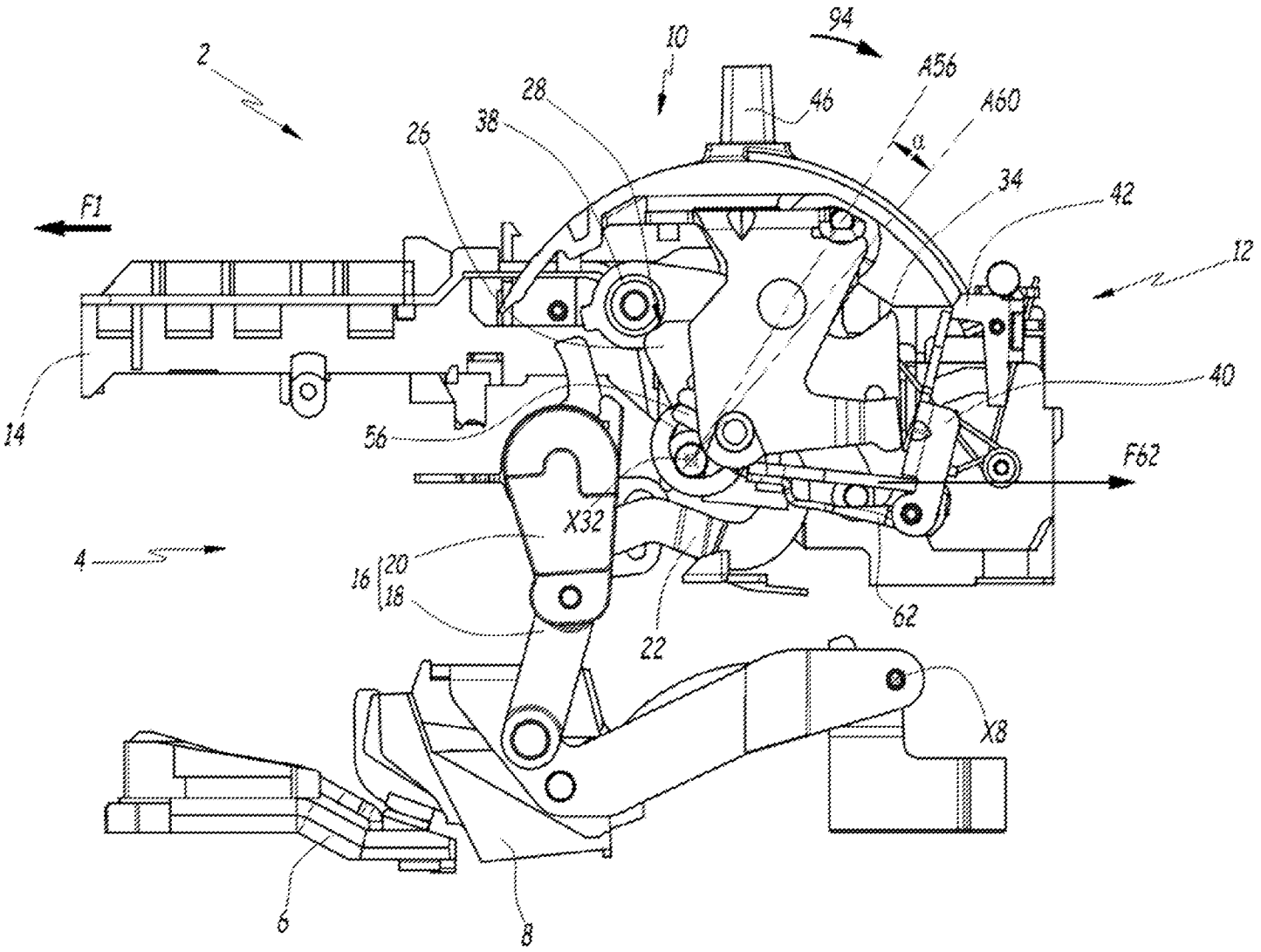
FIG. 2 is a view analogous to FIG. 1, the switching device being in a second configuration different from that of FIG. 1.

In the closing configuration illustrated in FIGS. 1 and 2 the stops 86 face lugs 90 of the latch 40 but without any contact force being generated between the stops 86 and the lugs 90. The safety device 62 is subject to its own weight, represented by an arrow F62 in FIGS. 2 and 3, which exerts a moment tending to cause the device 62 to turn about the axis X32 in the anticlockwise direction in the drawings. This moment tends to hold the stops 86 facing the lugs 90. The amplitude of the movement of the safety device 62 is limited by the pivot axis X40 of the latch 40 accommodated inside the internal volume 82.

Figure 3:
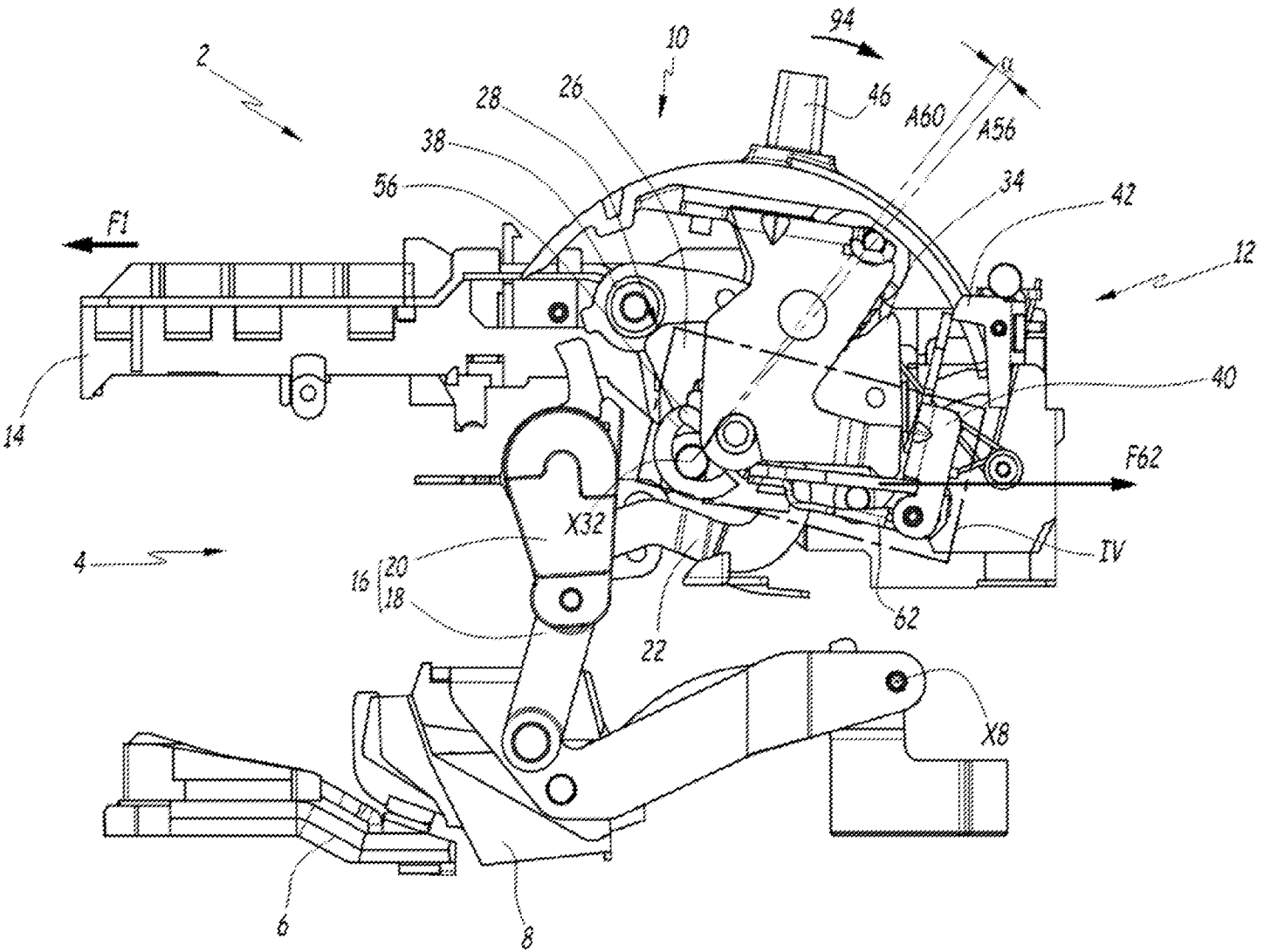
FIG. 3 is a view analogous to FIG. 1, the switching device being represented in a third configuration different from the previous ones.

In the FIG. 3 configuration the stops 86 cooperate with the lugs 90, that is to say a contact force is generated between the stops 86 and the lugs 90.

The lugs 90 are disposed radially to the axis X40 and each has a bearing surface 92 oriented away from the axis X40.

In the closing configuration the shorter sides 88 of the stops 86 bear on the surfaces 92 of the lugs 90, generating a contact force that tends to hold the stops 86 facing the lugs 90.

To be more precise, in the example illustrated the moment resulting from the contact force between the stops 86 and the lugs 90 tends to cause the safety device 62 to pivot about the axis X32 in the anticlockwise direction in the figures, that is to say upwards.

The functioning of the switch device 2 is described next.

In the closing configuration shown in FIG. 1, the lever 10 is in a closing position and the angle α has a minimum value, that is to say the angle α is negative and has a maximum absolute value.

The lug 36 of the hook 34 is accommodated in the slot 74 of the latch 40, which is held by the pawl 42.

The spring 56, under tension, holds the upper link 26 in contact with the rod 38.

The bottom link 22 pushes the toggle joint 16 into the deployed configuration in which the lower link 18 holds the separable contacts 6 and 8 in the closed state.

Subjected to its own weight F62, the safety device 62 is in a position such that the stops 86 remain facing the lugs 90 of the latch 40.

To cause the device 2 to pass manually from the closed state to the open state, an operative causes the lever 10 to pivot about the pivot axis X47 from the closing position toward the opening position. In the example illustrated in the figures this corresponds to a pivoting movement of the lever 10 in the clockwise direction. The movement of the handle 46 is represented by an arrow 94 in FIGS. 1 to 3.

As the movement of the handle 46 in the direction of the arrow 94 continues the lever 10 passes through an intermediate position between the closing position and the dead point position, as represented in FIG. 2.

The tension of the spring 56 holds the surface 28 of the upper link 26 in bearing engagement on the rod 38. Thus the spring 56 exerts a torque that opposes the movement of the lever 10 by the operative and holds the separable contacts 6 and 8 in the closed state.

In this configuration, if the operative releases the lever 10, the lever 10 returns under the action of the spring 56 to the closing position illustrated in FIG. 1. In this sense, in the closing configuration of the device 2 the closed state of the separable contacts 6 and 8 is a stable state.

If, on the other hand, the operative continues to move the lever 10 towards the opening position, the lever 10 passes through the dead point position. The angle α is zero, that is to say that when the axis A56 of the spring 56 is aligned with the neutral axis A60 and the moment of the tension force of the spring 56 on the upper link 26 is itself also zero.

However, at this stage it is undesirable for the contacts 6 and 8 not to be open prematurely.

The cooperation of the stops 86 with the lugs 90 prevents any movement in translation of the upper link 22, preventing the switching mechanism 4 from moving the contacts 6 and 8 towards their open state if the pivot angle α is not strictly positive.

In FIG. 3 the lever 10 is represented in another intermediate position between the dead point position and the opening position. In this other intermediate position the angle α is strictly positive, that is to say the axis A56 of the spring 56 is situated on the other side of the neutral axis A60 relative to the closing and intermediate configurations represented in FIGS. 1 and 2.

The moment of the tension force of the spring 56 on the upper link 26 tends to cause the upper link 26 to pivot about the pivot axis X30 in the anticlockwise direction in FIG. 3. However, pivoting movement of the upper link 26 is prevented because of the cooperation of the stops 86 with the lugs 90 of the latch 40.

Conjointly, the moment of the tension force of the spring 56 on the lever 10, transmitted via the support 44, no longer opposes the movement of the lever in the direction of the arrow 94 but, to the contrary, complements the force of the operative and drives the lever 10 towards the opening position. In other words, the spring 56 exerts a force that drives the contacts 6 and 8 towards the open state.

The boss 50 being attached to the handle 46, the pivoting movement of the lever 10 is taken up by the boss 50, the movement of the boss 50 being represented by an arrow 96 in FIG. 4. Conjointly, the boss 50 of the support 44 of the handle 46 comes to bear on the face 84 of the first element 64 of the safety device 62, as illustrated in FIG. 4.

Bearing on the face 84, the boss 50 generates a force the moment of which conjointly opposes the moment of the weight of the device 62 and the moment of the contact force between the stops 86 and the lugs 90. The device 62 is therefore pushed by the boss 50 and also pivots about the axis X32 in the direction of the arrow 96, that is to say in the clockwise direction here.

In the FIG. 4 intermediate position the stop 86 still cooperates with the lug 90. In other words, the side 88 is still in contact with the bearing surface 92, preventing any movement in translation of the device 62 and thus preventing pivoting of the upper link 26 despite the moment of the tension force of the spring 56.

In other words, the lugs 90 and the stops 86 are projections that together constitute a holding device that prevents the movements of the lower link 22 and therefore of the toggle joint 16 when the lever 10 is in an intermediate position beyond the dead point position.

The movement of the handle 46 continuing in the same direction, here illustrated by the arrow 94, the movement of the boss 50 in the direction of the arrow 96 also continues, until the lever 10 reaches a so-called "release" position in which the stops 86 no longer cooperate with the lugs 90. The movement in translation of the device 62 by the action of the spring 56 is no longer prevented.

In other words, as long as the lever 10 has not passed the release position, which is an intermediate position between the dead point position and the opening position, the holding device prevents the switching mechanism 4 from moving the contacts 6 and 8 towards their open state.

In the release position of the lever 10 the angle α is strictly positive and the moment of the tension force of the spring 56 on the upper link 26 has a non-zero value that does not depend on the speed at which the lever 10 moves but does depend on the value of the angle α in the release position of the lever 10.

The upper link 26 then pivots about the pivot axis X30, driving the lower link 22, which drives the toggle joint 16, which separates the mobile contact 8 from the fixed contact 6. In particular, the speed at which the contacts 6 and 8 separate does not depend on the speed at which the lever 10 moves but does depend on the moment of the tension force of the spring 56 when the lever 10 is in the release position.

The spring 56 and the geometry of the parts, in particular the value of the angle α when the lever 10 is in the release position, are preferably designed so that the speed at which the contacts 6 and 8 separate is sufficient to reduce to an acceptable level the risks of electrical arcing on manual opening.

It is clear that in the release position of the lever 10 the angle α is greater than a strictly positive minimum value so that the moment of the force of the spring 56 is non-zero. Conversely, too great an angle α is preferably avoided so that the device 2 is not too bulky.

In practice, the angle α in the release position of the lever 10 is for example between 1° and 6° inclusive, preferably between 2° and 5° inclusive, more preferably between 3° and 4° inclusive.

During the movement in translation of the device 62 the bosses 50 bear on the face 84 of the central part 70, preventing rotation of the handle 46 in the direction of the arrow 94, that is to say preventing rotation of the lever 10 beyond the release position.

Once folding up of the toggle joint 16 has finished, the device 62 is in a so-called "advanced" position, as represented in FIG. 5, in which the notches 78 are situated facing the bosses 50 and allow continued pivoting movement of the lever 10 beyond the release position. The lever 10 is then in the opening position.

Conversely, if for any reason the movement of the toggle joint 16 is prevented during the manoeuvre, for example if the fixed and mobile contacts 6 and 8 are welded to one another following an electrical fault, the folding up movement of the toggle joint 16 and therefore of the device 62 is prevented. Actuated by an operative, the lever 10 cannot be placed in the opening position represented in FIG. 5 but remains immobilized in the release position, alerting the operative to an abnormal situation.

In the event of automatic tripping of the switching device 2, which is in the closed state as represented in FIG. 1, the pawl 42 releases the latch 40 under the action of an external command.

The latch 40 then pivots about the axis X40 in the clockwise direction in FIG. 1, releasing the lug 36 from the hook 34. Conjointly, the rotation of the latch 40 about the axis X40 drives the rotation of the lugs 90 about the axis X40, thereby interrupting the cooperation of the stops 86 with the lugs 90.

It is clear that the holding device does not impede the correct functioning of the device 62 and of the latch 40 either in the case of automatic tripping or in the case of manual opening.

Acted on by the tension of the spring 56, the hook 34 pivots in the anticlockwise direction about the axis X34, entraining with it the upper link 26 in rotation about the axis X34, which closes up the angle α.

When the angle α reaches a positive value the moment of the force exerted by the spring 56 on the upper link 26 then causes the upper link 26 to pivot about the pivot axis X30, the upper link 26 entraining with it the lower link 22. The lower link 22 then pulls on the toggle joint 16, which folds up and moves the mobile contact 8 away from the fixed contact 6. The switching device 2 is then open.

In the example shown, the safety device 62 is held in position by gravity, because of the effect of its own weight. In a variant that is not illustrated a return device such as a spring may be provided to hold the stops 86 facing the lugs 90 when the switching device 2 is in the closing configuration.

In accordance with another variant that is not illustrated, a plate of the same type as the plate 70 is adapted to be deformed elastically by the action of the bosses 50 whereas the second element 66, which includes the stops 86, is rigid. When the plate is not deformed the stops 86 face the lugs 90. When the plate is deformed by the action of the bosses 50 the plate has a convexity oriented towards the second element 66 and the second element 66 and therefore the stops 86 move away from the plate, into a position in which the stops 86 no longer cooperate with the lugs 90.

The embodiment and the variants mentioned hereinabove may be combined with one another to generate new embodiments of the invention, provided they are technically possible.

The invention claimed is:

1. An electrical switching device, comprising separable electrical contacts, a switching mechanism and a control lever, in which:

the switching mechanism is configured to move the separable contacts reversibly and selectively between a stable closed state and a stable open state, the control lever can be moved between a closing position and an opening position, the switching mechanism is configured to move the separable contacts from their closed state to their open state when the lever is moved from its closing position to its opening position, and to this end includes a spring which, between the closing position of the lever and a first intermediate position referred to as the "dead point" position, exerts a force that opposes the movement of the lever and which, between the dead-point position and the opening position of the lever, exerts a force that drives the contacts towards the open state, wherein the switching mechanism includes a holding device which is configured to prevent the switching mechanism from moving the contacts towards their open state when the lever is moved from the closing position to the opening position and when the lever has not passed a second intermediate position located between the dead-point position and the opening position, wherein the switching mechanism further includes a safety device that prevents the movements of the lever from the second intermediate position towards the opening position if the separable contacts are not completely open, wherein the holding device is integrated into the safety device, wherein one of the separable contacts is a mobile contact connected to the switching mechanism, the safety device including a plate that is connected to the mobile contact and that cooperates with a latch for automatically tripping the switching mechanism, and wherein the holding device includes two projections respectively connected to the plate and to the latch, the two projections cooperating together in such a manner that the plate prevents the movements of the mobile contact, the lever being furthermore connected to a pusher pin that is adapted, when the lever is in the second intermediate position, to push the plate into a position in which the two projections no longer cooperate together.

2. The switching device according to claim 1, wherein the two projections are a stop and a lug, the stop being connected to the plate whereas the lug is connected to the latch.

3. The switching device according to claim 2, wherein when the control lever is between the closing position and the second intermediate position, the safety device, subjected to its weight, is in a position such that the stops remain facing the lugs of the latch.

4. The switching device according to claim 1, wherein the safety device is made of metal.

5. The switching device according to claim 2, wherein the safety device includes a first element including the plate and a second element connected to the first element and including the stop.

6. The switching device according to claim 5, wherein the latch pivots about a pivot axis and wherein the second element is connected to a second end of the plate, the first element and the second element defining between them an internal volume in which the pivot axis of the latch is accommodated in such a manner as to limit the amplitude of the movements of the safety device when the stops are not cooperating with the lugs.

7. The switching device according to claim 1, wherein the dead point position and the second intermediate position of the lever define between them an angle between 1° and 6° inclusive.

8. The switching device according to claim 1, wherein the switching device is a circuit breaker.

9. The switching device according to claim 1, wherein the dead point position and the second intermediate position of the lever define between them an angle between 2° and 5° inclusive.

10. The switching device according to claim 1, wherein the dead point position and the second intermediate position of the lever define between them an angle between 3° and 4° inclusive.

* * * * *